US008561672B2

(12) United States Patent
Halbe et al.

(10) Patent No.: US 8,561,672 B2
(45) Date of Patent: Oct. 22, 2013

(54) REGENERATIVE HEAT EXCHANGER WITH A PLURALITY OF RADIAL SEALS FOR SEPARATING GASEOUS MEDIA

(75) Inventors: Volker Halbe, Olpe (DE); Heinz-Guenter Raths, Olpe (DE)

(73) Assignee: Balcke-Durr GmbH, Wenden (DE)

( * ) Notice: Subject to any disclaimer, the term of this patent is extended or adjusted under 35 U.S.C. 154(b) by 1401 days.

(21) Appl. No.: 12/178,067

(22) Filed: Jul. 23, 2008

(65) Prior Publication Data

US 2009/0056908 A1 Mar. 5, 2009

(30) Foreign Application Priority Data

Jul. 24, 2007 (EP) ..... 07014528

(51) Int. Cl.
*F28D 17/00* (2006.01)
*F23L 15/02* (2006.01)

(52) U.S. Cl.
USPC ..... 165/9; 165/6

(58) Field of Classification Search
USPC ..... 165/6, 7, 8, 9
See application file for complete search history.

(56) References Cited

U.S. PATENT DOCUMENTS 1,939,153 A * 12/1933 Villasuso ..... 165/5
2,337,907 A * 12/1943 Lundstrom ..... 165/7
2,347,857 A * 5/1944 Waitkus ..... 165/7
2,803,508 A * 8/1957 Nilsson et al. ..... 165/9
3,185,208 A * 5/1965 Chute ..... 165/9
3,321,011 A * 5/1967 Kalbfleisch et al. ..... 165/7
3,780,498 A * 12/1973 Wenner ..... 165/7
3,799,242 A * 3/1974 Harris et al. ..... 165/7
3,875,994 A * 4/1975 Lewakowski et al. ..... 165/8
4,114,680 A * 9/1978 Kritzler et al. ..... 165/9
4,446,911 A * 5/1984 Reidick et al. ..... 165/7
4,509,583 A * 4/1985 Raths ..... 165/8
4,612,024 A * 9/1986 Muller-Odenwald ..... 165/7
4,669,531 A * 6/1987 Conde ..... 165/9
5,397,548 A * 3/1995 Kritzler et al. ..... 165/7
5,643,538 A * 7/1997 Morlec et al. ..... 165/6
5,678,625 A * 10/1997 Schluter et al. ..... 165/7

FOREIGN PATENT DOCUMENTS

DE 4420131 C2 6/1994

* cited by examiner

*Primary Examiner* — Ljiljana Ciric
(74) *Attorney, Agent, or Firm* — Baker & Hostetler LLP

(57) ABSTRACT

A regenerative heat exchanger for the heat exchange of gaseous media with a substantially cylindrical heat storage body including a radial seal for use in a regenerative heat exchanger and a method for separating gaseous media in a regenerative heat exchanger. The heat storage body of the regenerative heat exchanger may include a plurality of radially extending sector walls which subdivide the heat storage body into sectors. At least two heat storage chambers which are arranged behind one another in the radial direction are provided within a sector, which heat storage chambers are arranged for the through-flow of gaseous media.

6 Claims, 3 Drawing Sheets

REGENERATIVE HEAT EXCHANGER WITH A PLURALITY OF RADIAL SEALS FOR SEPARATING GASEOUS MEDIA

CROSS-REFERENCE TO RELATED APPLICATIONS

This application claims priority to the filing of EP 07014528.9 filed on Jul. 24, 2007, the entire contents of which is hereby incorporated by reference therein.

FIELD OF THE INVENTION

A regenerative heat exchanger and radial seal for use with the same and method for separating gaseous media in a regenerative heat exchanger is disclosed.

The invention relates to a regenerative heat exchanger and a radial seal for use in a regenerative heat exchanger. The invention further relates to a method for separating gaseous media in a regenerative heat exchanger.

In known heat exchangers of this kind, a usually cylindrical heat storage body is provided which is arranged to allow the through-flow of gaseous media. Said heat storage bodies are subdivided into sectors by radially extending walls, which hereinafter will be referred to as sector walls. The sector walls extend substantially continuous from the longitudinal axis of the heat storage body up to the heat storage edge and are aligned parallel to the longitudinal axis or lie in a plane with the same. For reasons of construction and cost-effectiveness, the sector walls are usually evenly distributed in the heat storage body, so that sectors of the same form and same volume are obtained. Since the heat storage bodies partly have a diameter of 20 m and more, the sectors are subdivided for constructional reasons by the introduction of further walls into several heat storage chambers that can be flowed through by gaseous media. Several heat storage chambers are often arranged behind one another within a sector in the radial direction of the heat storage body.

BACKGROUND OF THE INVENTION

Principally, there are recuperative or regenerative heat exchanger systems for heat exchange between gaseous media. In the case of recuperative heat exchangers, the flow of the heat-emitting medium is applied directly to one or several flows of heat-absorbing media and the heat is transferred directly through a separating wall. In the case of regenerators, the heat is transferred by means of a heat-storing intermediate medium. Such heat-storing intermediate media are arranged in regenerative heat exchangers in the heat storage chambers of the heat storage body. These frequently concern stacked steel sheet layers which may be enameled when necessary. They are frequently arranged as basket systems which can be inserted as a whole in a heat storage chamber and will fill the same. As an alternative, ceramic bodies or heating surfaces made of plastic are partly used as heat-storing intermediate media.

In the case of known heat exchangers, the heat storage body is arranged either to be fixed or rotatable about its longitudinal axis. The first case is related to as "stator" and the latter case as "rotor". In a heat exchanger with a rotor, the rotor housing including the gas duct connections fastened to the same is arranged in a fixed way, so that the rotor will rotate through the different gas streams. In a heat exchanger with a stator however, rotating gas duct connections, which are so-called rotating hoods, are arranged on both face sides of the stator. In both variants, the different areas of the heat storage body are flowed through in an alternating manner by all existing gas streams.

The heat-emitting gaseous medium flows through the heat storage body from one face side to the other and thus heats the heating elements which are arranged therein in the individual heat storage chambers and which store this heat. Furthermore, one or several heat-absorbing gaseous media flow through the heat storage body, which also occurs from one face side to the other. As a result of the rotation of the rotor or the rotating hoods, the heated heat elements are flowed through by the cold gas streams and thus heat the same.

In the area of power plants, a hot, heat-emitting exhaust gas stream and a cold, heat-absorbing air stream is frequently guided through the heat storage body. This concerns the process of air-preheating. The heated air is then subjected to firing and is then accordingly designated as combustion air. The combustion air heat increased by the heat exchanger substitutes parts of the energy contained in the fuel, thus reducing the fuel quantity required for the firing. As a result, the quantity of $CO_2$ released in the firing is reduced.

Furthermore, the described heat exchangers can also be used for gas preheating. In the case of heat exchangers which are arranged as so-called DeSOX plants, a hot crude gas with high SOx content is cooled for example and a clean gas with low SOx content is heated. In the case of so-called DeNOx plants, a hot clean gas with low NOx content is cooled and a crude gas with high NOx content is heated.

The heat-emitting gas stream and the heat-absorbing gas stream(s) are usually guided to flow against one another through the heat storage body, in line with the countercurrent principle. The heat-absorbing gas is guided out of the heat storage body on the side on which the heat-emitting gas is introduced into the heat storage body. This is known as the hot side of the heat exchanger. Opposite of the same, the cooled heat-emitting gas is ejected and the still cool heat-absorbing gas is injected. This is accordingly the cold side. In the case of a regenerative heat exchanger which is arranged for example for air preheating, it comprises a gas inlet and air outlet on the hot side and a gas outlet and air inlet on the cold side. The exhaust gas flows through an exhaust gas area which extends from the hot to the cold side of the heat exchanger, whereas the combustion air flows through a combustion air area which extends from the cold to the hot side.

The subdivision of the heat exchanger body in heat storage chambers is provided in order to prevent that the different gas streams will mix with each other. Heat-emitting and heat-absorbing gas is guided simultaneously through the different chambers separated from each other. In order to ensure a through-flow or an around-flow of the heat-storing intermediate media located in the heat storage chambers, the heat storage chambers are open on the face sides of the heat storage body.

In order to separate the different gas streams from each other, one or several radial seals are provided on the face sides of the heat storage body. A radial seal is often arranged as a strip or beam and extends orthogonally to the rotational axis or longitudinal axis of the heat exchange body over the diameter of the heat storage body. It is usually arranged in a planar manner and extends through the center point of the heat storage body. It is frequently made of metal or other materials like plastic for example and can be arranged integrally or be made of several parts.

The radial seal can be arranged to be adjustable in the direction of the longitudinal axis of the heat storage body, which means away from the heat storage body or towards the heat storage body. Frequently, the radial seals are arranged in this manner in order to compensate heat-induced deformations of the heat storage body. The sealing gap between the radial seal and the face side of the heat storage body can be kept as small as possible in order to reduce leakages between the various gas streams. Maintaining a minimum sealing gap is necessary in order to ensure the twistability of the heat storage body and radial seal relative to each other.

The radial seal typically consists of two or more sealing arms, with one sealing arm extending substantially from the rotational axis to the outside edge of the heat storage body. The number of sealing arms usually depends on the number of the various existing gas streams. If in a heat exchanger for example which uses a rotor as a heat storage body two gas streams flow through the rotor, two sealing arms each are provided both on the cold as well as the hot side, and three sealing arms in the case of three gas streams, etc. Since the radial seal is arranged in a stationary manner relative to the rotational movement of the rotor, the openings of the heat storage chambers rotate beneath the radial seal. In the case of a complete rotation of the rotor, each point of the face surfaces of the rotor is once beneath and above each sealing arm.

The radial seals are arranged in known regenerative heat exchangers in such a way that one sector wall lies beneath and above a sealing arm in any rotational position, i.e. in any random position of heat storage body and radial seal relative to each other. As a result, the different gas areas such as the combustion air area and the exhaust gas area are always separated by a sector wall extending radially from the rotational axis to the heat storage body edge.

In order to further reduce the leakage between the different gas areas, regenerative heat exchangers have been presented in which the radial seals are arranged in such a way that two sector walls are arranged above and below a rotational arm at least temporarily during the operation of the heat exchanger. In this way, the sectors and thus also the heat storage chambers arranged therein are covered completely once each by the sealing arms during a revolution of the rotor or a revolution of the rotating hood. This helps reduce leakage and improves the efficiency of the heat exchanger. Such a heat exchanger is presented for example in DE 44 20 131 C2, in which at least two adjacent sector walls are arranged beneath a sealing arm even during each rotational position.

Permanent mechanical oscillations are obtained by the continuous closing and opening of the heat storage chambers. They are caused by the different pressure conditions caused by the opening and closing of the heat storage chambers and act in a pulsating manner on the radial seals. This process is called "pumping" of the seals. The intensity of this pumping and thus also the strength of the action on the radial seal depends on the pressure differences present between the various gas streams and the surface area of the seals. Since this process is repeated continuously, the average sealing gap height increases. Moreover, wear and tear of the radial seals and the face surfaces of the heat exchanger body will increase considerably. These factors lead to an increase in leakage. A larger leakage means higher power requirement for the drive of the fans which are required for transporting the flue gases or the air, which shows in a deterioration of the efficiency of the regenerative heat exchanger. In addition to this deterioration, higher leakages lead to an increase in pollutant emissions such as $CO_2$, $NO_x$, $SO_2$, and ashes, which one wishes to keep as low as possible. Moreover, exhaust gas residues can be entrained in the leakage stream which extends beneath the radial seal between the different gas areas, which exhaust gas residues can attack the surfaces of the radial seals, thus further reducing the tightness of the radial seal strips.

SUMMARY OF THE INVENTION

The invention is therefore based on the object of providing a regenerative heat exchanger, a radial seal for use in a regenerative heat exchanger, and a method for separating gaseous media in a regenerative heat exchanger through which the pumping of the seals and thus the leakage between the different gas areas and the wear and tear of the radial seals and the face surfaces of the heat storage body are reduced.

This object is achieved with the regenerative heat exchanger according to claim 1. Advantageous embodiments are shown in the sub-claims which are dependent on the same.

The regenerative heat exchanger comprises a cylindrical heat storage body which is subdivided into sectors by a plurality of radial sector walls, with each sector comprising at least two heat storage chambers which are arranged behind one another in the radial direction. The heat storage chambers are arranged for through-flow of the gaseous media and therefore have openings in the area of the face surfaces of the heat storage body. Furthermore, there is at least one radial seal on a face surface of the heat storage body, preferably on both face surfaces, which is arranged as a cover surface for the heat storage chamber openings. The radial seal is arranged in such a way that it completely covers in an alternating manner every heating storage chamber opening during rotation of the rotor or the rotating hoods. The openings of the heat storage chambers are completely closed and opened again during operation, with each opening being covered at least once by each radial seal during a complete revolution of the rotor or the rotating hood. When the heat chambers are arranged to be continuous from one face side to another, it is appropriate to form and arrange the radial seals on both face sides in such a way that both openings in a chamber are closed and opened substantially simultaneously and this chamber is thus sealed in its entirety at the respective rotating position. This is advantageously achieved in such a way that the radial seals which are arranged on both face sides and are opposite of each other are substantially arranged similarly to coincide with each other.

According to the invention, the radial seal is arranged in such a way that of the heat storage chambers of a sector which are arranged radially behind one another it at least partly covers the opening of at least one of the heat storage chambers in any rotational position, i.e. in any random position of the heat storage chamber and radial seal relative to one another. The principal idea of the invention is arranging the opening surfaces of the heat storage chambers arranged behind one another within a sector and the cover surface of the radial direction relative to one another in such a way that at no time all heat storage chambers of a sector arranged radially behind one another are covered by the radial seal at the same time and thus not at any rotational angle position of the rotor or the rotating hood. This relative arrangement can principally be achieved both by a respective arrangement of the radial seal as well as by a respective arrangement of the heat storage chamber geometries. The geometries of the sector walls and the heat storage chambers are maintained for reasons of construction and cost-effectiveness and the adjustment is made in the radial seal. All geometries can principally be used for the radial seal which cause the above effect.

The fact that in the at least one heat storage chamber of the heat storage chambers of a sector arranged radially behind one another there is at most a partial covering means in other words that said heat storage chamber is not completely covered by the radial seal or not at all. In contrast to prior known heat exchangers, not all heat storage chambers of a sector arranged behind one another are completely covered at the same time. The covering of this at least one chamber is therefore temporally separated in the invention from the covering of the other chambers arranged behind one another, whereas in certain rotor or rotating hood positions in regenerative heat exchangers known from the state of the art all of these chambers are covered at the same time. As a result of this "temporal drawing" of the covering processes, the occurring oscillations are reduced considerably, which oscillations occur through the different pressure conditions during the opening and closing of the heat storage chambers. As a result, the interaction of the oscillations on the radial seals is reduced. A "pumping" of the seals is prevented or reduced considerably. T his leads to lower wear and tear and thus lower leakages and longer service lives of the radial seals. Moreover, the efficiency of the respective entire power plant is improved.

The simultaneous covering of all heat exchanger chambers of a sector which are arranged behind one another in the state of the art is obtained on the one hand from the fact that the sectors are formed by straight radial sector walls and the heat storage chambers and sectors arranged therein are arranged in an evenly distributed manner in the heat storage body. This arrangement is obtained inevitably from constructional aspects and cost-effectiveness. On the other hand, the individual sealing arms of the radial seal were always arranged for the same reasons in a linear way, and partly with dovetail-like expansions in the area of the edge of the heating storage body. It was only recognized in the present invention now that a change of the geometry of the radial seal which is arranged with respect to the geometry of the heat storage chambers and the rotational speed of the rotor or rotating hoods causes the desired effect, which is reduction of the oscillations.

In order to further reduce the amount of oscillations it is preferable that in each rotational position more than one heat storage chamber of the heat storage chambers of a sector which are arranged radially behind one another is partly opened. In a preferred embodiment, the radial seal is arranged in such a way that it will completely cover not more than one heat storage chamber of the heat storage chambers of a sector which are arranged behind one another at any given time, which means at any rotational angle position of the rotor or the rotational hoods. As a result, the interaction of the oscillations which originate from the opening and closing of several heat storage chambers is avoided and the pumping of the seals is further reduced.

In a further preferred embodiment, each radial seal comprises at least two sealing arms. At least one sealing arm is arranged asymmetrically of these at least two sealing arms of the radial seal which extend substantially from the longitudinal axis radially to the outside towards the edge of the heating storage body. This means that the geometry of the at least one sealing arm is arranged in such a way that the surface area of the sealing arm is not symmetrical when seen in a plan view. This excludes both axial symmetry as well as point symmetry. It is not possible to find any axis or point about which the sealing arm surface can be mirrored. Such an arrangement allows achieving a time-staggered covering of the individual heat storage chambers.

In a further preferred embodiment, the individual sealing arms of the radial seal are divided into sealing arm segments. The individual segments are arranged one behind the other in the radial direction and are directly adjacent to each other, so that they are joined into a sealing arm. The two outside edges of a segment are arranged in a substantially linear way. Moreover, the outside edges of adjacent sealing arm segments are mutually offset or additionally at an angle relative to their adjacent outside edges. In this case however, the outside edges on the same sealing arm side are considered. As a result of the offset of the outside edges against each other or the angled arrangement of the outside edges, it is avoided that all heat storage chambers arranged behind one another within a sector will be covered simultaneously by a sealing arm.

The heat storage bodies are frequently arranged in such a way that they have several coaxial ring walls. These ring walls are frequently arranged in a cylindrical way and have the longitudinal axis of the heat storage body as the common axis. Therefore the ring walls intersect the individual sectors and divide these into subsectors in the radial direction. Said subsectors can correspond to the dimensions of a heat storage chamber. It is principally also possible to subdivide the subsectors further into several heat storage chambers. When a heat storage body is subdivided by such ring walls into subsectors it is preferable that the individual sealing arm segments of the sealing arms are arranged in such a way that they extend in the radial direction substantially over a subsector or several adjacent subsectors. If a subsector corresponds to a heat storage chamber, it is appropriate that a sealing arm segment extending over this subsector is arranged to cover the chamber. This ensures that the edge offset between two sealing arm segments or the point of intersection between two mutually angled outside edges of two adjacent sealing elements is arranged substantially over an area where two heat storage chambers or two subsectors will abut. This embodiment ensures that the arrangement of the individual sealing arm segments can be adjusted better to individual subsectors, so that the sequence of covering of the individual subsectors or heat storage chambers can be optimized during operation, which thus further reduces the entire occurrence of oscillations.

In a further preferred embodiment, at least one sealing arm is divided into three sealing arm segments, with the inner segment closest to the rotational axis being arranged conically. The conical inner segment is aligned in such a way that it widens substantially in the radial direction. The adjacent middle segment tapers in the radial direction and preferably at least one edge of the middle segment is arranged offset to the adjacent edge of the inner segment in the circumferential direction of the heat storage body. As a result of the tapering of the middle segment in the radial direction, the edges of the middle segment are angled against the inner segment that widens conically to the outside. The cross-sectional surface area of the outside segment widens further in the radial direction and its edges are thus arranged in an angled manner against those of the middle segment. Calculations and tests by the applicant have shown that such a geometric arrangement of a sealing arm is especially advantageous in using standard heat storage bodies and further minimizes the occurrence of oscillations.

In order to simplify the production of radial seals and to enable a more cost-effective production and installation of the same it is advantageous to arrange all sealing arms similarly. This is also appropriate for the reason that the heat storage chambers are usually arranged evenly distributed in the heat storage body and thus an optimal arrangement of a sealing arm can be used for all sealing arms.

It is further preferable that the radial seal is arranged in such a way that the inflow and outflow surfaces for the respective gaseous media are substantially of the same size. The inflow and outflow surfaces of the various gaseous media can further differ in their size and can be adjusted to the respectively present specific requirements such as maximum permissible pressure losses.

The object in accordance with the invention is achieved further with a radial seal. Advantageous further developments are recited in the claims.

The radial seal consisting of at least two sealing arms comprises at least one sealing arm which is arranged asymmetrically. Such an arrangement ensures that the extent of pumping acting on the seals is reduced.

The solution of the object in accordance with the invention is further achieved by a method for separating gaseous media in a regenerative heat exchanger.

The method is that for separating the various gas streams the openings of the various heat storage chambers are completely covered in an alternating manner in heat exchanger operation in an already described heat exchanger body of a regenerative heat exchanger with sectors and heat storage chambers which can be flowed through and are arranged behind one another in the radial direction. This means that the heat storage chambers are permanently closed and opened again. This achieves a separation between the individual gas streams. In order to reduce the occurrence of the oscillations that have a negative effect on the oscillations occurring in the radial direction and are caused by the pressure differences within the heat storage body, the heat storage chambers are covered in the manner that in the case of heat storage chambers which are arranged behind one another in the radial direction within a sector the opening of at least one heat storage chamber is covered at most partly in every operating state of the heat exchanger. Preferably, the opening of at most one of these heat storage chambers is covered completely in every operating state.

BRIEF DESCRIPTION OF THE DRAWINGS

The invention is now explained in closer detail by reference to embodiments shown in the drawings which show schematically.

DETAILED DESCRIPTION OF THE DRAWINGS

Figure 1:
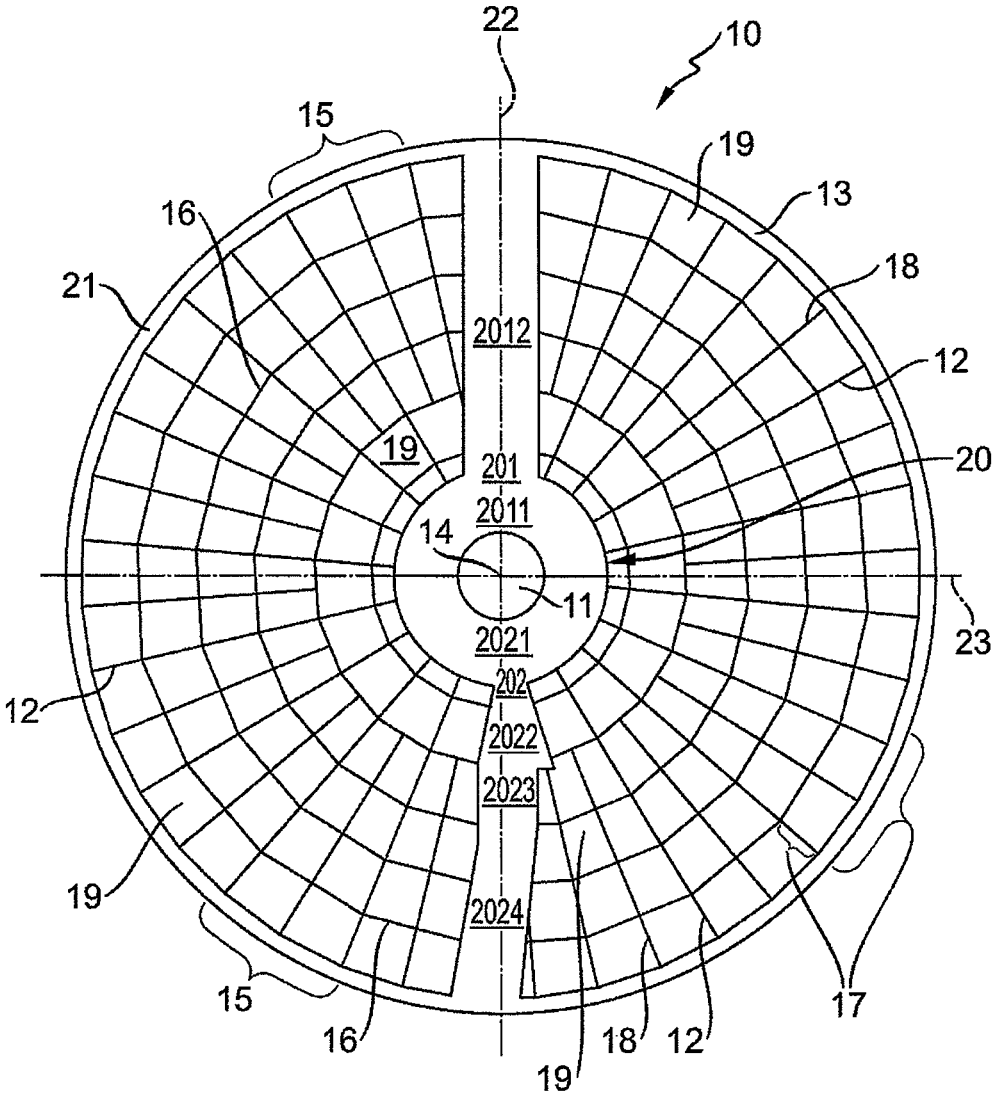
FIG. 1 shows a top view of a heat storage body of a regenerative heat exchanger arranged as a rotor, comprising a radial seal with two sealing arms, with one arm being arranged according to the state of the art and the other arm according to the present invention.

The same components are provided in the drawings with the same reference numerals in the different embodiments of the invention as described herein.

FIG. 1 shows a top view of a rotor 10 of a regenerative heat exchanger. A shaft 11 is arranged at the center point 14 of rotor 10, with the rotor 10 rotating about the same. It is principally possible to arrange the rotor in such a way that it rotates both clockwise as well as counter-clockwise. The rotation of the rotor 10 occurs by means of a motive drive (not shown here). Rotor 10 comprises circumferentially arranged sector walls 12 in its interior which extend radially from the shaft 11 to the outside edge 13 of rotor 10. Sector walls 12 are arranged in a straight line and extend from one face side of rotor 10 to the other. All sector walls 12 are distributed evenly and circumferentially in the rotor 10, so that two adjacent sector walls 12 form sectors 15 of the same size. In summary, rotor 10 is subdivided into twenty sectors 15 of the same size. One sector 15 is delimited on its two sides by a sector wall 12 each, on its inside wall by the shaft 11 and on its outside by edge 13 of the rotor 10 which is arranged as a cylindrical outside jacket.

Furthermore, several ring walls 16 are arranged within the rotor which are arranged in a circumferential way and inherently closed. The ring walls 16 are arranged coaxially with respect to each other, with the common axis being the rotational axis passing through the central point 14. The ring walls 16 are arranged approximately cylindrical, with the section of a ring wall 16 between two sector walls 12 each being arranged in a straight line and being slightly angled relative to the adjacent ring wall sections. The ring walls 16 also extend through the entire rotor 10 through one face side to the other. The ring walls 16 further subdivide the sectors 15 into subsectors 17. Each of the four outer subsectors 17 of each sector 15 is subdivided into two heat storage chamber 19 by a radially extending intermediate wall 18, with two heat storage chambers 19 of approximately the same size being obtained in the four outer subsectors 17 by the intermediate wall 18 per subsector 17, with each intermediate wall extending approximately in the middle. The use of intermediate walls 18 is not mandatory and occurs in the present example for constructional reasons. The inner two subsectors 17 are not subdivided further, so that these two subsectors 17 each form a heat storage chamber 19. Ten heat storage chambers 19 are therefore present in total per sector 15. The number of heat storage chambers per sector can principally be varied and is usually obtained from the size of the respective heat storage body.

As a result of the presence of the intermediate wall 18, the heat storage chambers 19 are arranged not only behind one another in the rotor-radial direction, but partly also adjacent to one another. The individual heat storage chambers 19 are filled with heating elements (not shown) such as steel sheet.

A radial seal 20 is arranged above the rotor 10 which extends in the radial direction of the rotor from one side to the other. The radial seal 20 is enclosed in a circumferential seal 21 which is also arranged on the rotor face side and follows the course of the edge 13 of rotor 10. The radial seal 20 consists of an upper sealing arm 201 and a bottom sealing arm 202 which abut each other in the area of the horizontal central line 23 which extends through the central point 14 of rotor 10. The radial seal 20 which consists of the two sealing arms 201 and 202 subdivides the rotor 10 into two gas areas, one to the right of the radial seal 20 and one to the left of the same. Heat can thus be transferred from a gaseous medium to another with the rotor 10 which is present here. The radial seal 20 and the circumferential seal 21 enclosing the same are arranged in a stationary manner relative to the rotational movements of the rotor 10, so that the rotor 10 moves beneath the radial seal 20.

The upper sealing arm 201 is arranged according to the radial seals known from the state of the art, whereas the bottom sealing arm 202 is arranged according to the present invention. Sealing arm 201 is shown according to embodiments known from the state of the art in order to clearly show the differences between the radial seal in accordance with the invention and the state of the art. In regenerative heat exchanger according to the invention, all sealing arms are obviously arranged according to the sealing arm 202.

Both sealing arms 201, 202 each have an inner, semicircular part 2011, 2021 which rest on each other and thus form a complete ring with a circular base surface. A recess for shaft 11 is provided in the middle of the ring. Adjacent to the semi-ring 2011 of sealing arm 201 there is a sealing web 2012 which extends linearly and radially to the outside and from the semi-ring 2011 to the rotor edge 13. The sealing web 2012 has a constant width over its entire progression. The sealing arm 201 is arranged symmetrically, with the central line 22 extending vertically through the central point 14 of the rotor 10 also forming its mirror axis simultaneously.

In the rotor position as shown in FIG. 1, the sealing arm 201 covers the right heat storage chambers 19 arranged behind one another of the outer four subsectors 17 of a sector 15 and the two inner heat storage chambers 19. As a result, all heat storage chambers 19 of this sector which are arranged behind one another in the rotor-radial direction are covered by the sealing arm 201. The oscillations which are caused by the opening and closing of the individual heat storage chambers 19 are amplified through the pressure differences prevailing on both gas sides of rotor 10.

It is relevant for the present invention that the sealing arms are arranged in such a way that at a given time they will not cover all heat storage chambers 19 of a sector 15 which are arranged behind one another in the rotor-radial direction. It is irrelevant in this connection whether or not, as shown in this embodiment, a number of heat storage chambers 19 within a sector 15 are also partly arranged adjacent to one another in addition to the arrangement of the heat storage chambers 19 which are arranged behind one another in the rotor-radial direction. The right heat storage chambers 19 of the outer four subsectors 17 of a sector 15 are situated behind one another in the shown example as well as the two inner heat storage chambers 19 or subsectors 17 of the same sector 15 as well in addition the left heat storage chambers 19 of the four outer subsectors 17 together with the two inner heat storage chambers 19.

In contrast to the sealing arm 201, an inner arm segment 2022 is adjacent to the semi-ring 2021 in the bottom sealing arm 202 in accordance with the invention. It is arranged conically, with the narrow side resting on the semi-ring 2021, so that the inner segment 2022 widens in the radial direction. In the radial direction, the sealing arm segment 2022 extends up to the second ring wall 16, when seen from the inside to the outside. The inner sealing arm segment 2022 is therefore arranged to cover the portion not covered by the semi-ring 2021 of the first subsector 17 and the second subsector 17 (as seen from the inside to the outside) of each ring sector 15 at a respective rotor position.

A middle sealing arm segment 2023 is adjacent to the inner sealing arm segment 2022 in the radial direction. It tapers slightly in the radial direction and extends substantially in the radial direction between the second and third ring wall 16. Its two outside edges are each arranged in a linear way. The left outside edge is directly adjacent to the outside edge of the inner sealing segment 2022 and is slightly angled relative to the same. The right outside edge of the middle sealing segment 2023 on other hand is arranged slightly offset relative to the right outside edge of the inner sealing arm segment 2022.

An outer and final sealing arm segment 2024 is adjacent to the middle sealing arm segment 2023, which outer sealing arm segment extends up to the rotor edge 13. The outer edges are arranged in a linear way in this case too, as in the other sealing arm segments 2022, 2023. They are directly adjacent to the outside edges of the middle sealing arm 2023 and are slightly angled to the left relative to them. The cross-sectional surface of the outer sealing arm 2024 widens slightly as seen in the rotor-radial direction, so that its largest width is in the area of the rotor edge 13. The outer sealing arm segment 2024 extends substantially from the third ring wall 16 to the rotor edge 13 and thus extends in the radial direction approximately over three subsectors 17.

The sealing arm 202 is generally arranged asymmetrically. The geometric shape of the sealing arm 202 acts in the way that in each position of the rotor 10 at least one of the heat storage chambers 19 of a sector 15 arranged behind one another is not covered by the sealing arm 202 or only partly so. In the position as shown in FIG. 1 for example, the two outer of the heat storage chambers 19 which are arranged behind one another and situated beneath the sealing arm 202 are only partly covered. The other four heat storage chambers 19 which are also situated beneath the arm 202 are completely covered on the other hand. If the rotor 10 would rotate clockwise for example, the middle two of the covered heat storage chambers 19 would open at first before the two outer, partly covered heat storage chambers 19 would be covered completely. Nevertheless, each heat storage chamber 19 is covered once completely by the sealing arm 202 during each rotation of the rotor, so that a separation of the two gas areas from each other is always ensured.

Figure 2:
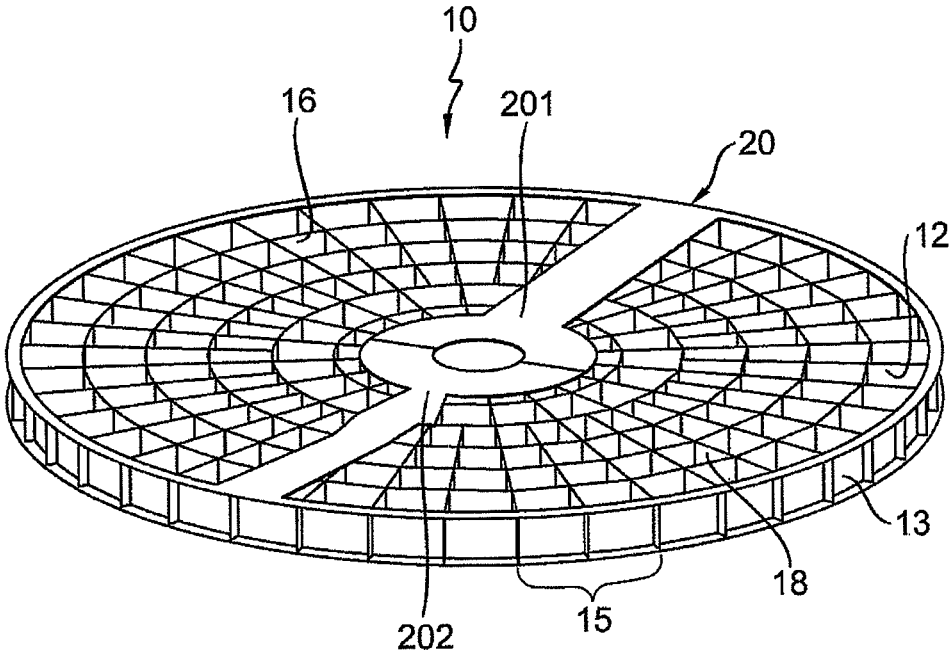
FIG. 2 shows a perspective side view of the rotor of FIG. 1.

FIG. 2 shows the rotor of FIG. 1 in a perspective side view. All walls, which means the sector walls 12, the ring walls 16 and the intermediate walls 18, extend through the entire rotor 10 in the axial direction from one face side through to the other.

Figure 3:
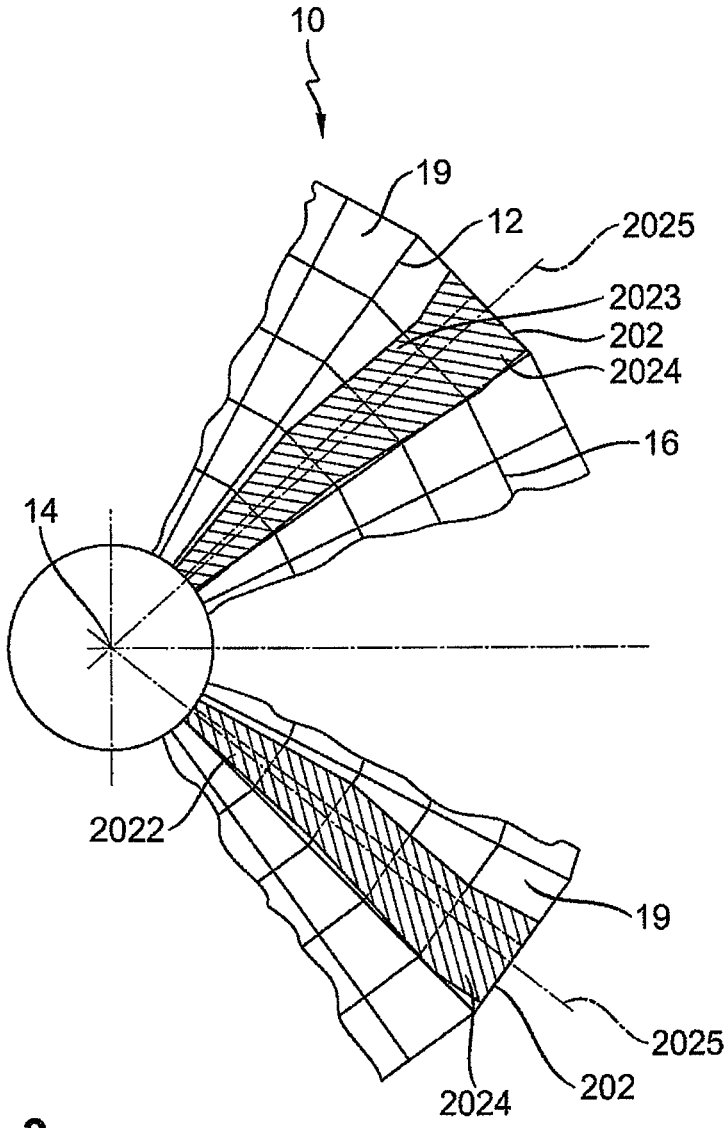
FIG. 3 shows a top view of a section of a heat storage body of a regenerative heat exchanger with a radial seal, which heat storage body is arranged as a stator.

FIG. 3 shows a top view of a section of a heat storage body 10 of a regenerative heat exchanger. The heat storage body 10 shown here is arranged as a stator in contrast to the heat storage body of FIGS. 1 and 2. This means that it is stationary and thus fixed. The arrangement of stator 10, i.e. its subdivision into sectors, subsectors and heat storage chambers, is substantially like the arrangement of the rotor of FIGS. 1 and 2. Furthermore, two radial sealing arms 202 are provided which are arranged in accordance with the invention and which are arranged above or below the stator 10 and resting on the same. The sealing arms 202 also have an inner arm segment 2022, a middle arm segment 2033 and an outer arm segment 2024, like the sealing arm in accordance with the invention from FIGS. 1 and 2. In contrast to the sealing arm from FIGS. 1 and 2, the outside edges of the arm segments are adjacent to the outside edge of the respectively adjacent segments in the embodiment as shown in FIG. 3 and are not arranged in an offset manner relative to the same. The sealing arms 202 are attached to the bottom side of the outside edge of a rotating hood (not shown) and rotate together with the same about the central point 14. At least one rotating hood is arranged on each face side of the stator 10. The central axes 2025 of the two sealing arms 202 intersect in the central point 14 of stator 10 under an angle of approximately 90°. The area which is enclosed by this angle is covered by the rotating hood. Since the sealing arms 202 are each arranged on the outside edge of the rotating hood, the areas situated outside of the rotating hood are sealed against the area enclosed by the rotating hood. The alignment of the sealing arms 202 under an angle of 90° with respect to each other is preferable for the embodiments with a stator as a heat storage body 10 because this configuration corresponds to the dimensions of usually used rotating hoods. In known embodiments, two rotating hoods are arranged in an axially symmetric way relative to each other at each face side in the known embodiments, so that in these embodiments a total of four sealing arms 202 in accordance with the invention are arranged in each face side.

What is claimed is:

1. A regenerative heat exchanger for heat exchange of gaseous media comprising:

a cylindrical heat storage body that comprises a plurality of radially extending sector walls, wherein two respectively adjacent sector walls delimiting a sector and in each sector at least two heat storage chambers being provided which are arranged behind one another in a radial direction of the cylindrical heat storage body, can be flowed through by the gaseous media and comprise openings for inflow and outflow of the gaseous media in an area of face sides of the cylindrical heat storage body; and at least one radial seal which is arranged on a face side of the heat storage body, arranged to separate streams of the gaseous media and forms a cover surface for the openings of the at least two heat storage chambers, with the at least one radial seal and the cylindrical heat storage body being twistable relative to each other and with the at least one radial seal being arranged to fully cover in an alternating manner all heat storage chamber openings on the one face side during an operation, wherein the at least one radial seal is arranged in such a way that of the at least two heat storage chambers of a sector which are arranged radially behind one another the radial seal at most partly covers the opening of at least one heat storage chamber in any rotational position of heat storage body and radial seal relative to one another.

2. The regenerative heat exchanger according to claim 1, wherein the radial seal comprises at least two sealing arms which each extend radially outwardly from a longitudinal axis of the cylindrical heat storage body to an edge of the cylindrical heat storage body, wherein at least one sealing arm is arranged asymmetrically.

3. The regenerative heat exchanger according to claim 1, wherein the radial seal comprises at least two sealing arms which each extend radially outwardly from a longitudinal axis of the cylindrical heat storage body to an edge of the cylindrical heat storage body, wherein the sealing arms are subdivided in the radial direction into mutually adjacent sealing arm segments, with the outside edges of a sealing arm segment each being in a straight line and angled or offset against the adjacent outside edges of the adjacent sealing arm segments.

4. The regenerative heat exchanger according to claim 3, wherein the cylindrical heat storage body comprises a plurality of coaxial ring walls which subdivide the sectors into subsectors, wherein each of the sealing arm segments extend in the radial direction of the cylindrical heat storage body over at least one of mutually adjacent subsectors.

5. The regenerative heat exchanger according to claim 4, wherein the at least one sealing arm comprises three sealing arm segments being arranged in a conical way, with an inner arm segment which is situated closest to the longitudinal axis of the cylindrical heat storage body, widening in the radial direction towards the edge of the cylindrical heat storage body, a middle segment tapering in the radial direction towards the edge of the cylindrical heat storage body and an outer segment widening in the radial direction towards the edge of the cylindrical heat storage body and being arranged in an angled way relative to the middle segment.

6. The regenerative heat exchanger according to claim 5, wherein the radial seal comprises at least two sealing arms which each extend radially to the outside from the longitudinal axis of the cylindrical heat storage body to the edge of the cylindrical heat storage body, wherein the at least two sealing arms are arranged as having an identical form.

* * * * *